US007210975B1

(12) United States Patent
Lubinitsky

(10) Patent No.: US 7,210,975 B1
(45) Date of Patent: May 1, 2007

(54) BINDING FOR A WATER RECREATIONAL DEVICE AND METHOD

(75) Inventor: Gregory Lubinitsky, 8 Markwood Rd., Forest Hills, NY (US) 11375

(73) Assignee: Gregory Lubinitsky, Forest Hills, NY (US)

( * ) Notice: Subject to any disclaimer, the term of this patent is extended or adjusted under 35 U.S.C. 154(b) by 0 days.

(21) Appl. No.: 11/295,742

(22) Filed: Dec. 6, 2005

(51) Int. Cl.
*B63B 35/85* (2006.01)

(52) U.S. Cl. ..... 441/70; 702/182

(58) Field of Classification Search ..... 441/70; 280/611, 617; 702/141, 142, 182
See application file for complete search history.

(56) References Cited

U.S. PATENT DOCUMENTS 6,539,336 B1 * 3/2003 Vock et al. ..... 702/182

* cited by examiner

*Primary Examiner*—Lars A. Olson

(57) ABSTRACT

Disclosed herein is a binding for a water recreational device and a method for facilitating the entry/exit of a foot for a rider into/from said binding. The binding comprises at least one boot with a flexible interior compartment for placing a rider's foot, and said binding equipped with sealed flexible inflatable/deflate able camera having an ability to fill/empty with/from fluid. The interior compartment has an ability to fix a rider's foot, when fluid in the camera is under pressure, and to unfix the foot, when the pressure of fluid in camera is released. Also disclosed the system of a safely slide off a rider's foot from the binding to avoid an injury.

28 Claims, 12 Drawing Sheets

BINDING FOR A WATER RECREATIONAL DEVICE AND METHOD

BACKGROUND OF THE INVENTION

Water-skiing is a recreational activity that has been enjoyed worldwide for several decades. Several different types of water-skiing are commonly recognized and classically include, e.g., slalom, trick, and jumping. Recently, other categories of water-skiing have been developed as a result of the inception of new ski devices, such as the hydro slide and most recently the wakeboard. All of these types of water-skiing have some common components: the rider is towed by a boat and the rider is positioned on a device that displaces water as the boat tows the rider.

Generally, in most types of water-skiing, the rider is secured to the surface of the ski device by a binding. The typical configuration of a binding relates to a two piece construction with a portion of material forming the heel piece and a separate portion of material forming the forefoot piece (see U.S. Pat. Nos. 6,036,561; 5,868,594; and 5,947,781). The two portions of material are brought adjacent to each other to form a foot socket, whereby the user slides their foot in the top between the two pieces and into the socket. Ski bindings have undergone many improvements over the years. Due to the potentially extreme torsion forces on the foot, ankle, and lower leg of the skier, it is important for the binding to snugly fit the foot of the skier. One augmentation to the ski binding that has been developed and is still preferred today to increase the stability of the skier's foot and combat these torsion forces is the addition of one or more flaps that wrap around the ankle portion of the binding. Concomitant with this increase in support and stability of the binding is an increase in the difficulty in inserting the skier's foot into the binding. Typically, the heel enclosure and the tongue of the forefoot enclosure extends upwardly and about the ankle. In most conventional bindings, the top of the heel enclosure and tongue of the forefoot enclosure define holes thereon which facilitate the separation of the two. However, the contact between the top of the heel enclosure and the tongue of the forefoot portion can be so tight that it is often necessary for the skier to apply a lubricant in the top of the binding to aid in the insertion of the skier's foot. Maintaining a container of lubricant in the boat can be a messy inconvenience.

There are known an attempts to avoid disadvantages, related to contamination, by means of improvement involves the provision of a reservoir for holding a lubricant that is securely attached or integral to the binding. The lubricant can be stored and ejected out of the reservoir, through a simple pump and duct mechanism, to the site of need on the binding (e.g., see U.S. Pat. No. 6,604,969). However this technical decision does not make away all problems, related to contamination of a rider's feet, a water recreational devices and an environment. Also it does not cut in full the problems related to safety the rider's feet during skiing, because the feet tightly insert in a foot socket and it is very difficult to pull it out when arise a need, especially in case of emergency.

SUMMARY OF THE INVENTION

The subject of the invention pertains to an improvement of bindings for a water recreational device, e.g., such as skis and wakeboards, wherein the improvement involves the snug binding fit, riding ability, and ensures riders' safety. The most efficient bindings would be to have it in someway loose, when rider's foot is inserting, tight when rider is riding, and loose again when rider want or emerge necessity to take off the binding.

According to the invention a binding for a water recreational device comprising a boot, having an interior compartment for rider's foot, and sealed flexible inflatable/deflate able camera having an ability to fill/empty with/from fluid such as a liquid, predominately water, a gas, predominately air, or both of said fluid, and said interior compartment having an ability to fix a rider's foot, when fluid in camera is under pressure, and to unfix a rider's foot, when the pressure of said fluid in said camera is released.

Another aspect of the subject invention pertains to design and emplacement of the camera in the boot.

Another aspect pertains to structure of the interior compartment, its kit and materials.

Another aspect of the subject invention pertains to means for pressurization fluid into camera.

Another aspect pertains to the binding comprising a pair of boot with cameras wherein cameras of both boots fluidly communicated with each other by means of a connector pipe.

A further aspect of the subject invention pertains to structure of the connector pipe and fluid communication in the binding.

A further aspect of the subject invention pertains to conjoint means for pressurization fluid into both cameras and fluid communications.

Another aspect of the subject invention pertains to a method of facilitating the insertion and removal of a rider's foot into and out of binding.

A further aspect of the subject invention pertains to a method of facilitating the insertion and removal of a rider's foot into and out of a pair of a binding, providing consummation the same pressure in both cameras of the bindings in case of pressurized, maintenance or faults the pressure in cameras.

These and other advantageous aspects of the subject invention are described in further detail below.

DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENTS

The term "binding" as used herein takes on its commonly understood meaning in the art, and refers to any type of structure designed for securing a foot to a water recreational device. Examples of common types of bindings used in the art are shown in U.S. Pat. Nos. 6,604,969, 6,036,561; 5,868,594; and 5,947,781.

The term "water recreational device" as used herein refers to any type of device designed for sliding on water as the rider is being towed. Examples of water recreational devices used in association with the subject bindings include skis (jump, trick, slalom etc.), hydro slides, wakeboards, and other similar existing devices or similar devices that have yet been developed.

As used herein, the term "fluid" refers to any type of gases or liquids or combination of gases and liquids, e.g., their mix, which can be used for pressurization into cameras, reservoirs, tanks, containers etc. Preferably it can be water, air and both.

The term "means for pressurization fluid" as used herein refers to any type of devices designed for pumping water, gas and their combination. Examples of means for pressurization fluid are pumps, including manual pumps, compressors, balloons, wherein said fluid is under pressure that is above than an atmospheric pressure, and other types of sources of fluid under pressure. After actuating said devices said fluid is transferred into any kinds of places, wherein a pressure is lower than the pressure in output of said devices.

As used herein, the term "fluid communication" refers to a connection, either direct or indirect (e.g., via a connector pipe communication), such that fluid can flow to and from those items communicating.

At the FIGS. the one-way arrow shows the direction of flow of the fluid in case of inflating or deflating cameras; the two-way arrow shows the direction of flow the fluid in case of aligning the fluid's pressure in cameras especially in case of emergency, if one foot is accidentally fall out from the binding.

Now turning to the Drawings.

Figure 1:
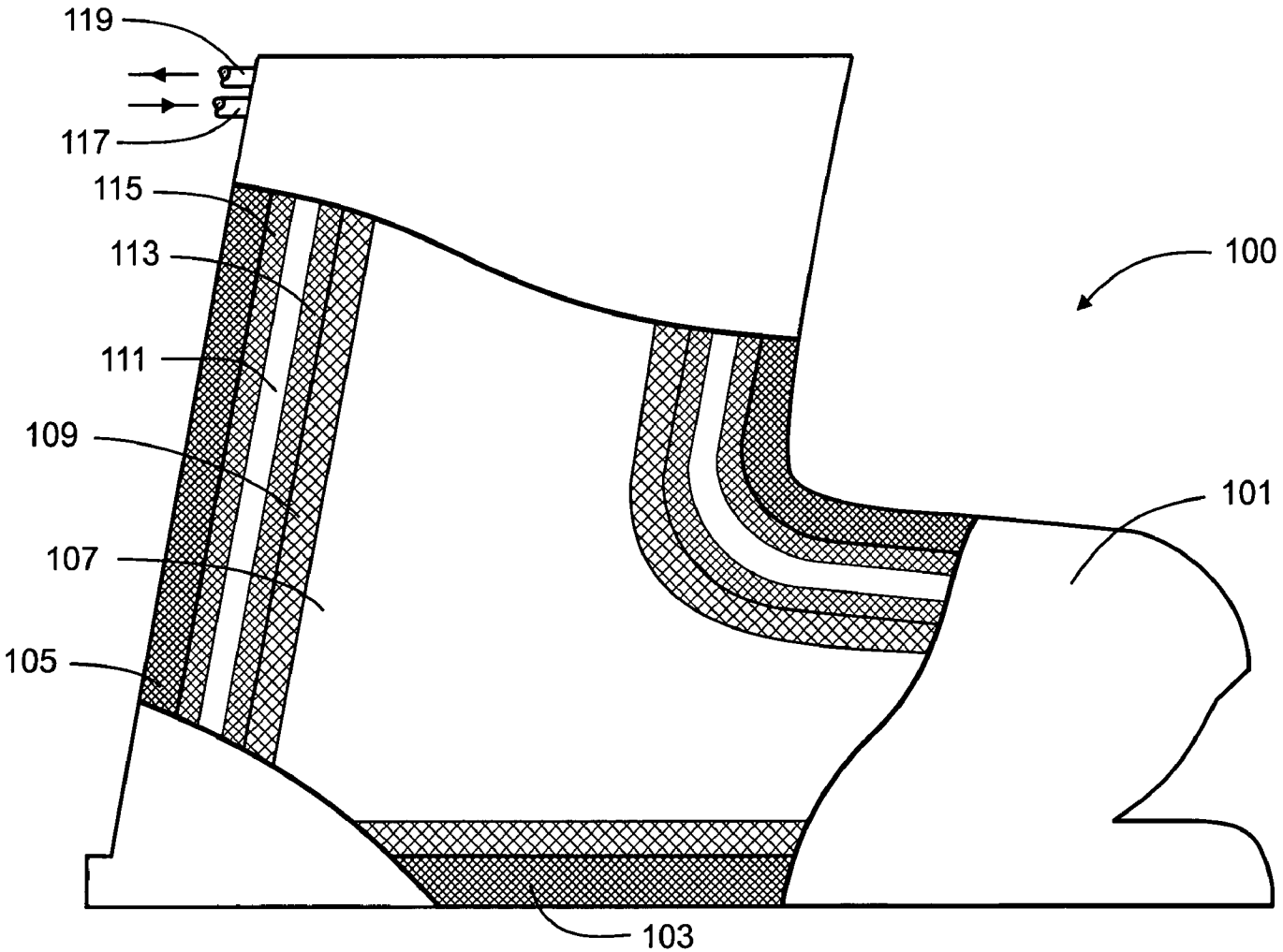
FIG. 1 is a partly sectional view of a binding in accordance with one embodiment of the present invention.

FIG. 1 shows an embodiment 100 of the subject binding for a water recreational device, in accordance with one of the preferred embodiments of the present invention. This embodiment 100 comprised boot's body 101 with sole 103 and side walls 105. The boot has an interior compartment 107 limited by its flexible body 109 for placing a foot (not shown). The binding equipped with sealed flexible inflatable/deflate able camera 111 with interior wall 113 and exterior wall 115. The camera 111 is placed inside of said boot and covers at least a part of said compartment. The camera 111 can be placed between at least a part of boot's body 101 and at least a part of compartment's body 109 and has an ability to fill/empty with/from fluid. The camera 111 has at least one input 117 for filling camera with fluid by means of its pressurization (the means for pressurization doesn't show) and at least one output 119 for emptying camera 111 from said fluid. The input 117 and output 119 are equipped with plugs (not shown). The input's plug can be realized as a back valve for protection of backflow of fluid (not shown). Also the input and output can be realized as a unit and can have one conjoint plug (not shown). The interior compartment 107 having an ability to fix a rider's foot by means of compartment's body 109, when a fluid in the camera 111 is under pressure, and to unfix a rider's foot,—when said fluid in the camera 111 is without pressure. The camera 111 can be made as a separate device having an ability to be placed inside and to be taken out of boot's body 101. The arrows show the direction of the fluid's flow.

As shown in FIG. 1, the basic structure of the binding 100 includes a boot's body 101, an interior compartment 107 for placing a rider's foot, and sealed flexible inflatable/deflate able camera 111 can be made as a separate device having an ability to be placed inside and to be taken out of boot's body 101. This feature of the camera gives the binding more opportunities in case of assembling, dissembling, repairing or changing parts of the binding. A fluid which is used for the filling the camera can be a liquid, predominately water, a gas, predominately air, or both of said fluid. The using the water and/or the air has a convenience, so far as they are free natural product. There are the following steps how the assembled binding is working:

a) providing an outflow said fluid from said camera through its output 119 and plug (not shown) of said output;

b) providing an entering rider's foot into compartment 107;

c) providing a closing an output 119;

d) providing pressurization said fluid into camera 111 through its input 117 and maintenance of a necessary pressure of said fluid into camera as far as of fixation the rider's feet into compartment 107;

e) providing an opening a plug of output 119 for providing an outflow said fluid from camera 111 for providing an exiting rider's foot from compartment 107.

Such fulfillment of the proposed binding for a water recreational device give an opportunity to facilitate the entry/exit of a foot for a rider into/from the binding of a water recreational device and quickly, comfortably and reliably fixate and unfix a rider's feet. When it is necessary, even during the exercises (e.g. wakeboarding), in emergency situation a rider can set free his (her) foot/feet from the binding by opening the camera's output's plug, what notably advance a safety of a rider and circumjacent people.

This embodiment has conveniences how in operation, so in maintaining, compare with known bindings for a water recreational devices and methods for facilitating the entry/exit of a foot for a rider into/from the binding.

Figure 2:
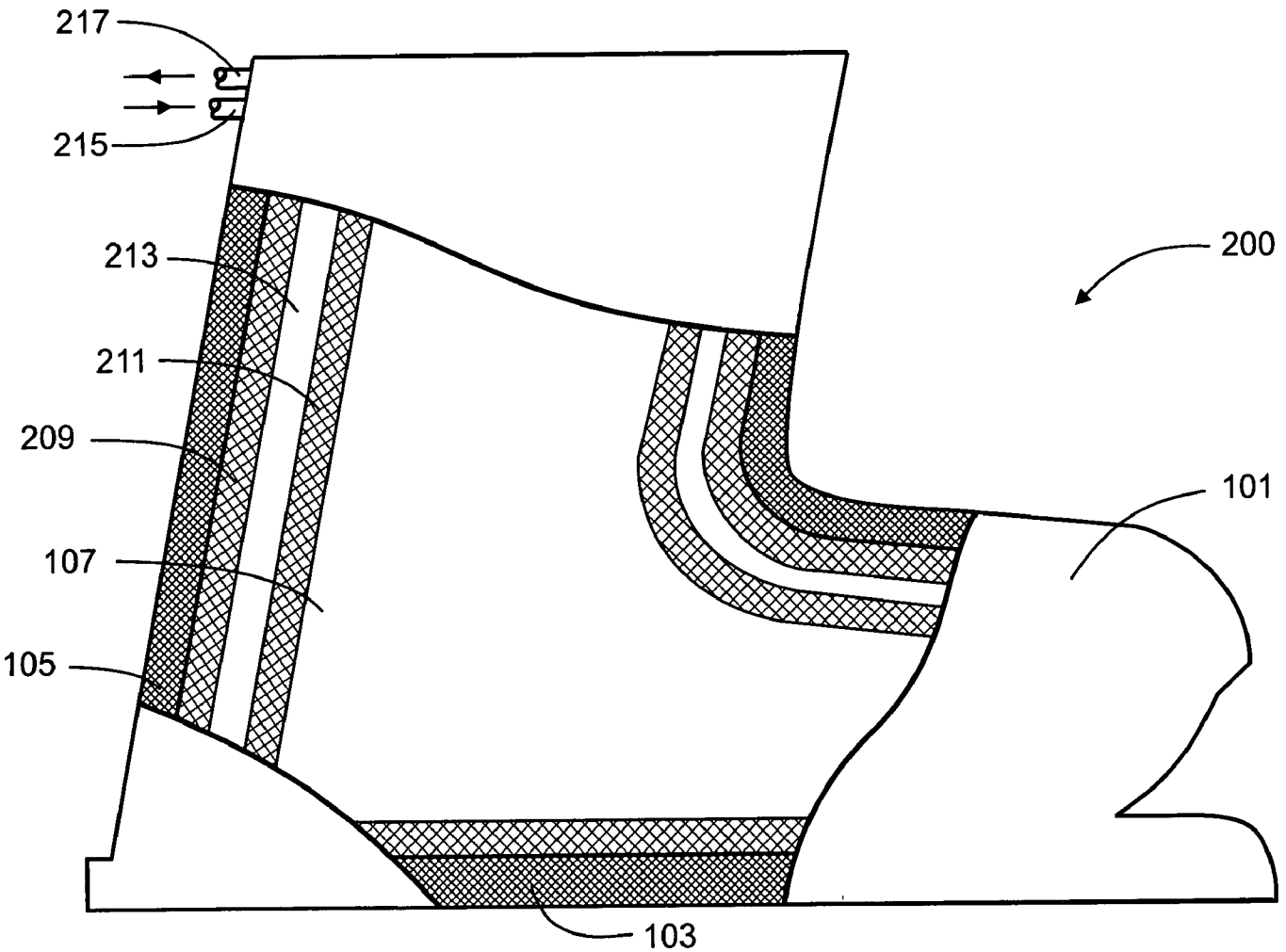
FIG. 2 is a partly sectional view of a binding in accordance with another embodiment of the present invention.

FIG. 2 shows an embodiment 200 of the subject binding for a water recreational device, in accordance with another of the preferred embodiments of the present invention. This embodiment 200 comprised boot's body 101 with sole 103 and side walls 105. The boot has an interior compartment 107 for the foot (not shown), wherein at least portion of compartment is made with a double wall (209—an exterior and 211—an interior compartment's walls). At least portion of said walls 209 and 211 is made from a flexible material and camera 111 (FIG. 1) can be place inside of double wall (not shown). Also by means of the walls 209 and 211 between them can be formed a sealed flexible inflatable/deflate able camera 213 having an ability to fill/empty with/from fluid. Camera 213 has at least one input 215 for filling with fluid by means of its pressurization (the means for pressurization doesn't show) and at least one output 217 for emptying camera 213 from said fluid. The input 215 and output 217 are equipped with plugs (not shown).

The distinction of this embodiment from the embodiment, shown on the FIG. 1, in design of the compartment 107, having a double wall, and in location the camera 213, which can be made separately from compartment or can be formed by its walls 209 and 211.

This embodiment also has all such conveniences compare with known bindings for a water recreational devices and of methods for facilitating the entry/exit of a foot for a rider into/from the binding thereof how the previous embodiment.

Figure 3:
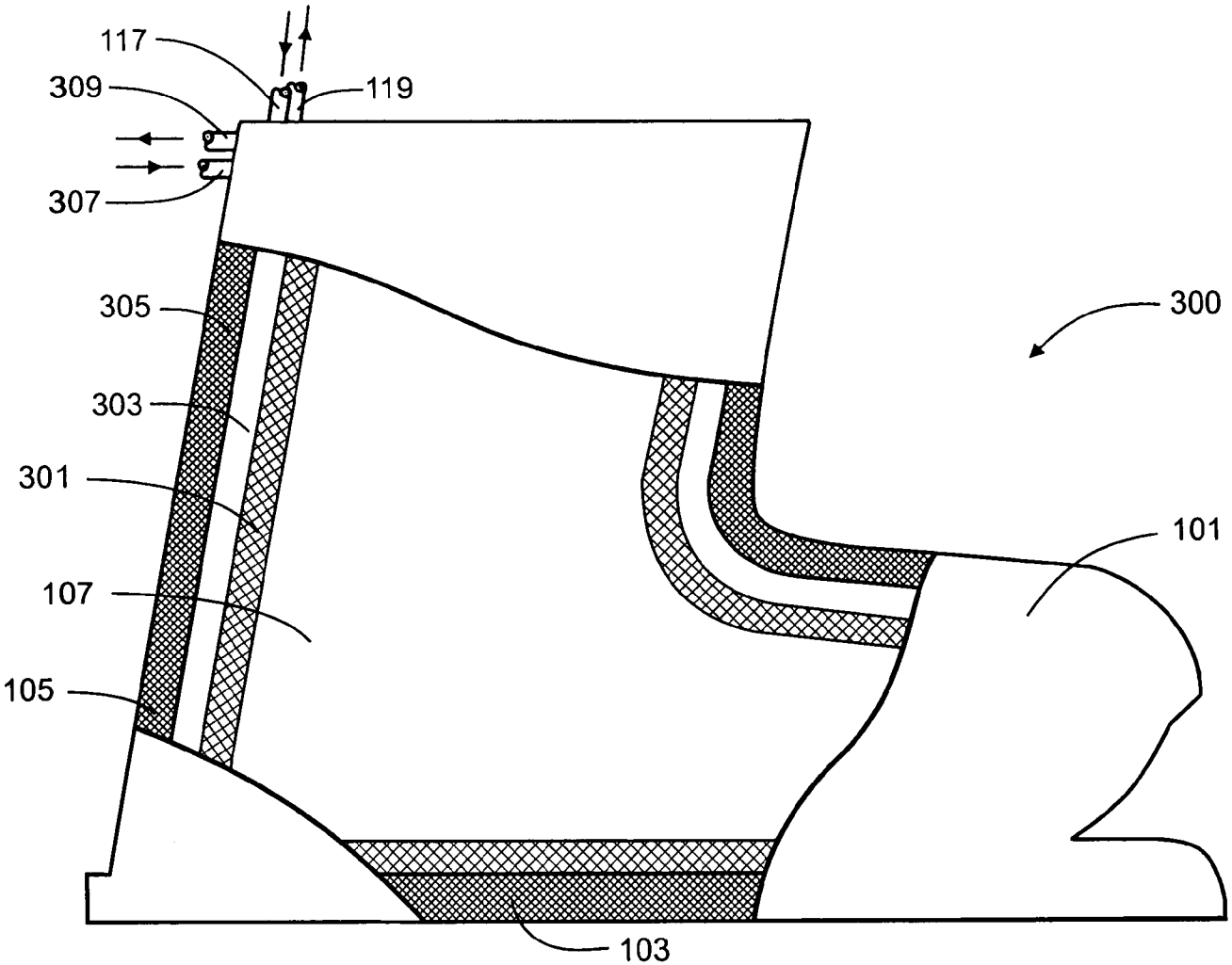
FIG. 3 is a partly sectional view of a binding in accordance with alternative embodiment of the present invention.

FIG. 3 shows an alternative embodiment 300 of the present invention. The distinction of an embodiment 300 and an embodiment 200 is in version of design of the compartment's camera. This embodiment 300 like an embodiment 200 comprised boot's body 101 with sole 103 and side walls 105. The boot has an interior compartment 107 for the foot with interior wall 301, but compartment's inflatable/deflate able camera 303 is formed by means compartment's interior wall 301 and at least portion 305 of site boot's wall 105. So an exterior wall 209 (FIG. 2) of said interior compartment's body is made as a portion 305 of site boot's wall 105 of the boot's body 101. Another words exterior compartment's wall 209 (FIG. 2) and at least portion 305 of site boot's wall 105 are realized as a unit. Camera 301 has at least one input 117 for filling with fluid by means of its pressurization (not shown) and at least one output 119 for emptying camera 303 from said fluid. The input 117 and output 119 are equipped with plugs (not shown). Alternatively camera can has at least one input 307 and at least one output 309, which are can be fixated directly to the portion 305 of the side walls 105 of the boot's body 101. An input 307 and an output 309 have the same functions as accordingly an input 117 and an output 119 and are equipped with plugs (not shown).

The operating with this embodiment is the same as the previous and this embodiment also has all such conveniences compare with known bindings for a water recreational devices and of methods for facilitating the entry/exit of a foot for a rider into/from the binding thereof how the previous embodiment.

Figure 4:
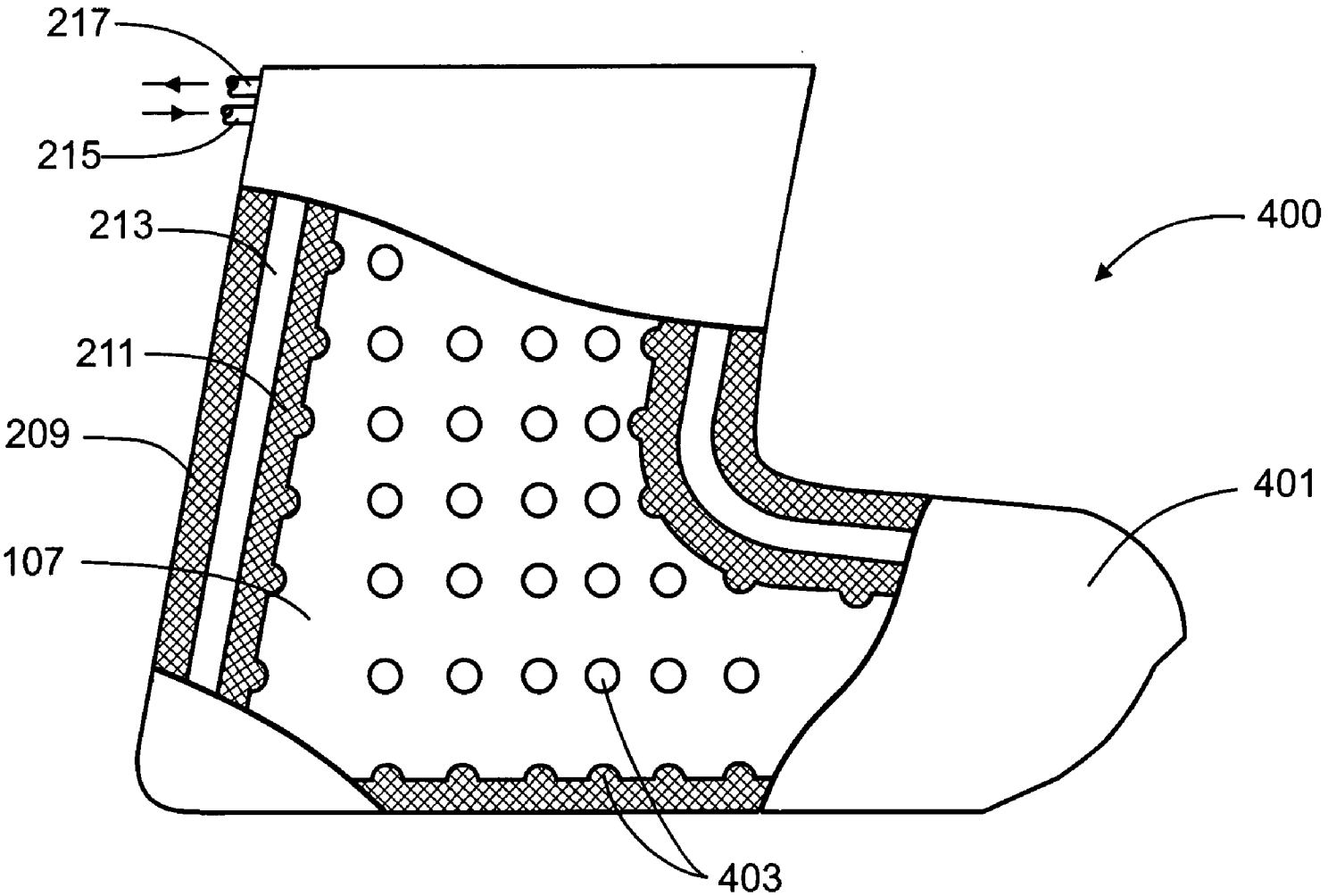
FIG. 4 is a partly sectional view of an interior compartment's body of a binding in accordance with one of embodiments of the present invention.

FIG. 4 shows a body 401 of interior compartment 107 for the foot, wherein at least portion of compartment is made with a double wall (209 is an exterior, and 211 is an interior wall). At least portion of said walls 209 and 211 is made from a flexible material and camera 111 (FIG. 1) can be place inside of double wall (not shown). Also by means of the walls 209 and 211 between them can be formed a sealed flexible inflatable/deflate able camera 213 having an ability to fill/empty with/from fluid. Camera 213 has at least one input 215 for filling with fluid by means of its pressurization (the means for pressurization doesn't show) and at least one output 217 for emptying camera 213 from said fluid. The input 215 and output 217 are equipped with plugs (not shown). At least part of a surface of the interior wall 211 inward of the interior compartment 107 can be made with bulges 403. This embodiment of interior compartment body is made to be able to take out of and insert into boot's body 101 (FIGS. 1, 2).

This embodiment of an interior compartment body (like the embodiments of an interior compartment body, shown on the FIGS. 1–2) having an ability to take out of and insert into boot's body 101.

There are the following alternative steps how the binding with this embodiment of an interior compartment body can working:

a) providing a getting out said compartment from said boot;

b) providing an entering rider's foot into said compartment;

c) providing an entering said compartment with rider's foot into said boot;

d) providing pressurization said fluid into said camera of said compartment as far as of fixation the rider's foot into said compartment and maintenance of a necessary pressure of said fluid into said camera, and e) providing an outflow said fluid from said camera for providing an exiting rider's foot from said compartment.

Such fulfillment of the interior compartment of proposed bindings for a water recreational device advance convenience of maintaining the binding and give an opportunity to facilitate the entry a rider's foot into the compartment and then compartment with foot—into the binding.

The presence of bulges 403 on the inward surface of the interior wall 211 of the interior compartment 107 (like in the embodiments of bindings, described above) providing the best circulation of the blood into the rider's feet's blood vessels, when the rider's feet is bind in the binding.

These and other advantages of this embodiment of an interior compartment body make embodiments of binding, which include such interior compartment, more comfortable and simpler in maintaining.

Figure 5A:
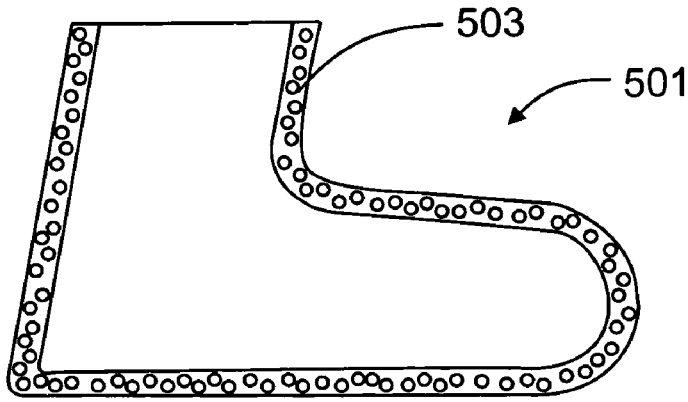
FIGS. 5A, 5B, 5C are a diagrammatic view of an alternative bodies of an insert, by which can be equipped an interior compartment of a binding in accordance with an alternative embodiments of the present invention.
Figure 5B:
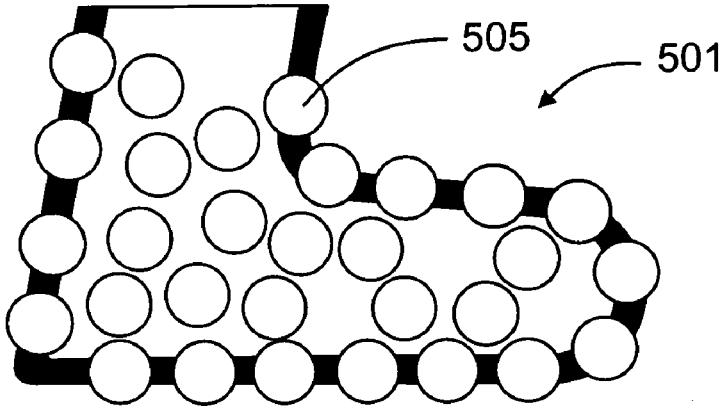
Figure 5C:
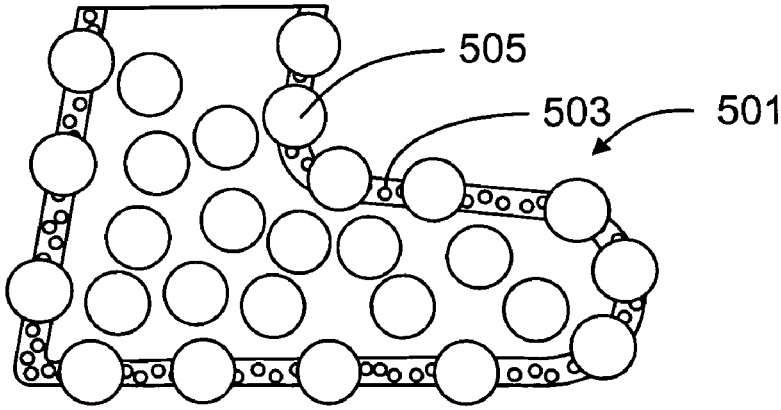

FIGS. 5A, 5B and 5C shows a body of an insert 501, by which can be equipped an interior compartment 107 (FIGS. 1–4). The insert is shaped as a sock and has an ability to be placed on a rider's foot and herewith is made from an elastic material and can has a porous 503 (FIG. 5A) or bubbly 505 (FIG. 5B) or both (FIG. 5C) structures.

There are the following alternative steps how the binding with this embodiment of an interior compartment's insert can work:

a) providing a getting out said insert from said compartment;

b) providing an entering rider's foot into said insert;

c) providing an entering said insert with rider's foot into said compartment;

d) providing pressurization said fluid into said camera of said binding as far as of fixation the rider's foot into said compartment and maintenance of a necessary pressure of said fluid into said camera, and e) providing an outflow said fluid from said camera for providing an exiting rider's foot from said compartment.

These additional kit more extend technological possibilities of bindings how in making, so in using.

Figure 6:
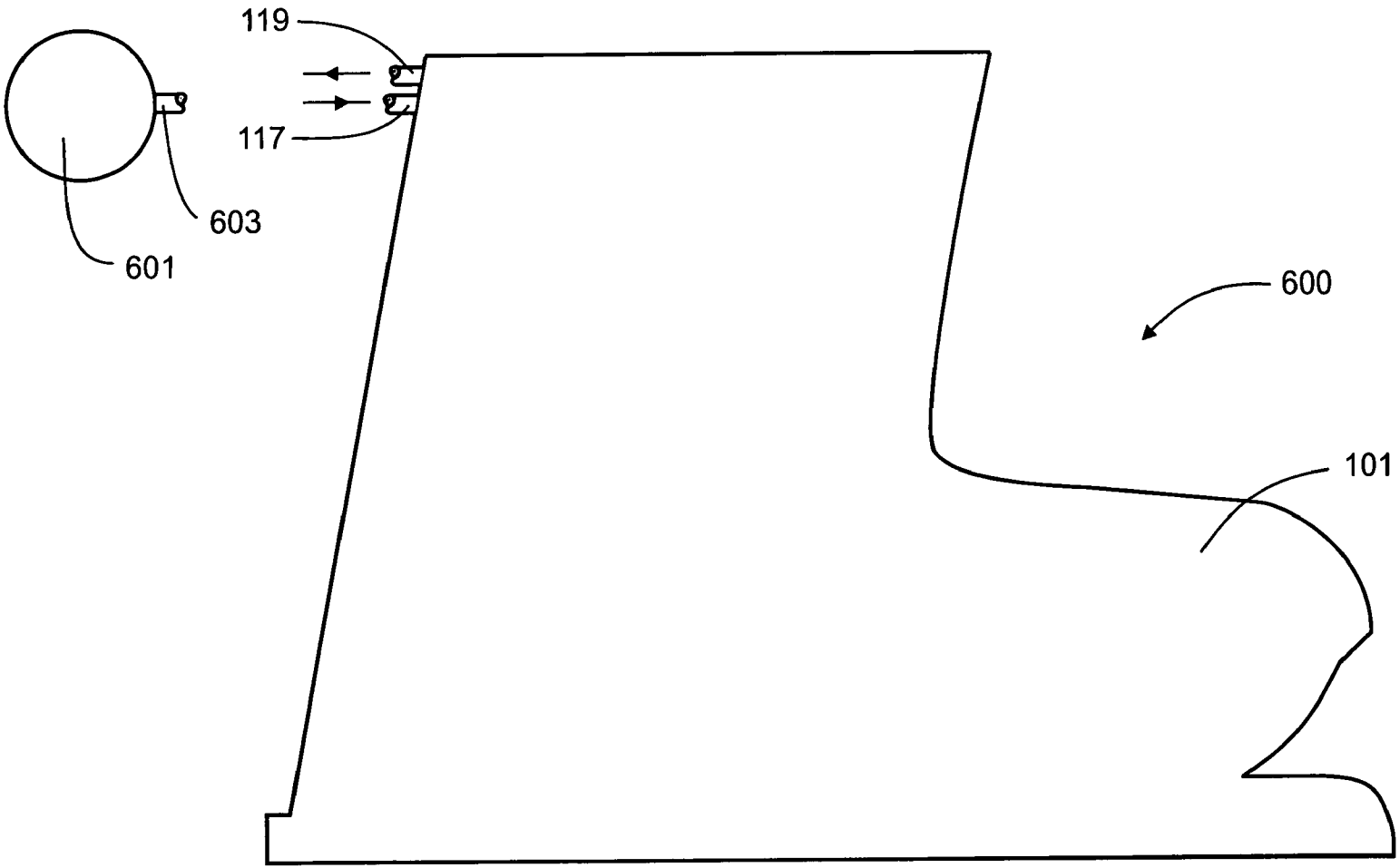
FIG. 6 is a diagrammatic view of a binding in accordance with alternative embodiment of the present invention; in this embodiment the binding is additionally equipped with means for pressurization a fluid into camera.

FIG. 6 diagrammatic shows an alternative embodiment 600 of the present invention. In accordance with this embodiment of the present invention the binding is additionally equipped with means 601 for pressurization a fluid into camera (camera is disposed inside of the binding body 101). Camera has at least one input 117 for filling camera with fluid by means 601 of its pressurization and at least one output 119 for emptying camera from said fluid. The input 117 and output 119 are equipped with plugs (not shown). The input's plug can be realized as a back valve for protection of backflow of fluid (not shown). An output 603 of the means 601 for pressurization a fluid connect with the input 117 of the camera. The camera's input's plug disposed between them. Upon actuating the means 601 for pressurization a fluid, said fluid is transferred into said camera. The means 601 for pressurization can has many known embodiments (not shown). For example, the means 601 for pressurization a fluid can be made as a manual pump, as a compressor, as a source of fluid, e.g., as a balloon, wherein said fluid is under pressure that is above the atmospheric pressure and wherein upon actuating said source of said fluid under pressure, said fluid is transferred into said camera. If a means 601 for pressurization a fluid into camera is used a pump, preferably, mechanism is squeezed and depressed by hand. Preferably, the means 601 for pressurization a fluid is aerodynamically configured and sized as to minimize a weight and interference with the performance of the binding.

There are the following main steps how a rider work with this embodiment of the binding after inserting his/her foot into the compartment of the binding:

a) providing a closing an output 119;

b) providing actuating means 601 for pressurization said fluid;

c) providing pressurization said fluid into camera 111 (FIGS. 1–3) by means 601 for pressurization said fluid through its input 117 and maintenance of a necessary pressure of said fluid into camera as far as of fixation the rider's feet into compartment;

e) providing an opening a plug of output 119 for providing an outflow said fluid from camera 111 for providing an exiting rider's foot from compartment.

Through such realization of binding at the same time with another advantages, immanent to another embodiments, this embodiment give to a rider a possibility offline to fill out the cameras and to be independent from a means for pressurization the fluid, located on a waterside or a tug. So these additional device more extend a technological possibilities of bindings in operation.

Figure 7:
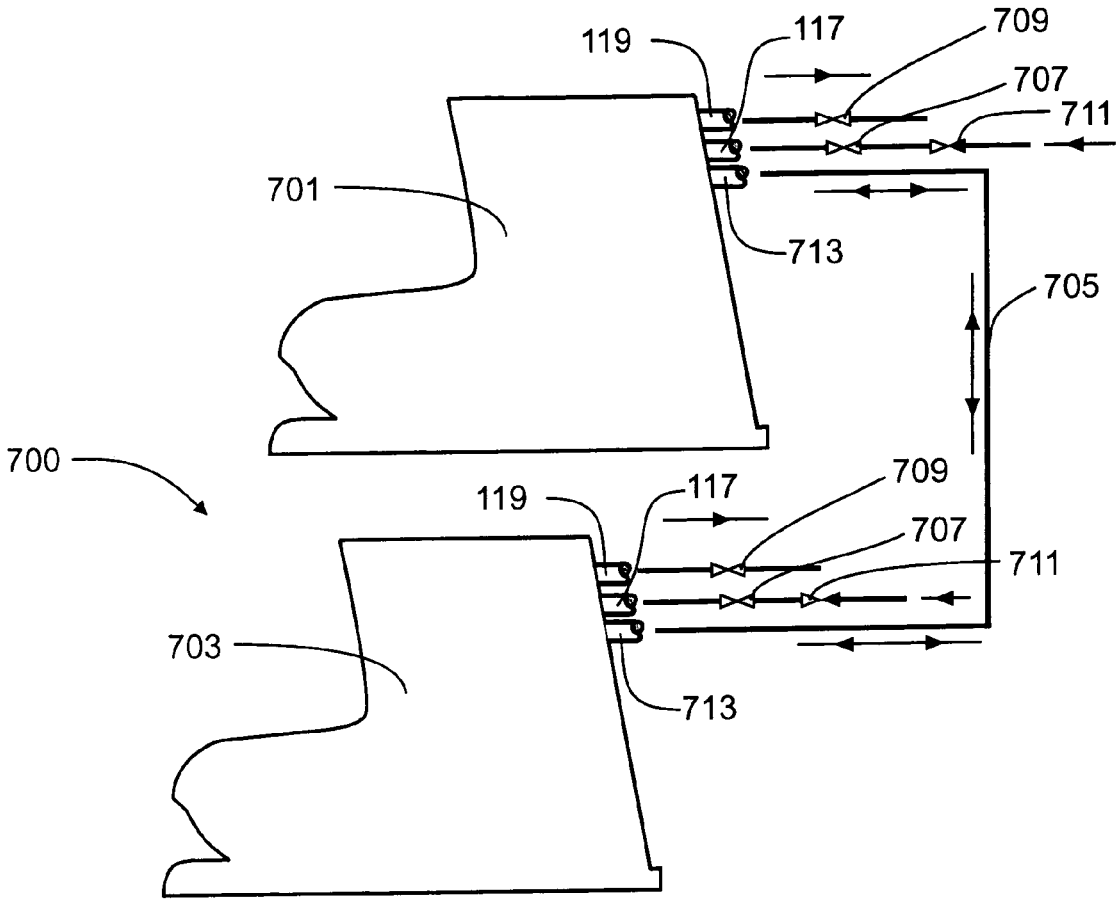
FIG. 7 diagrammatic shows an alternative embodiment of the present invention; in this embodiment the binding comprised a pair of boots with cameras wherein cameras of both boots fluidly communicated with each other by means of connector pipe.

FIG. 7 diagrammatic shows an alternative embodiment 700 of the present invention. In accordance with this embodiment of the present invention the binding comprised a pair of boots 701 and 703 with cameras (each camera is disposed inside of the binding body) wherein said cameras of both boots fluidly communicated with each other by means of connector pipe 705. Each camera has at least one input 117 for filling camera with fluid and at least one output 119 for emptying camera from said fluid. The input 117 and output 119 are equipped with plugs 707 and 709 accordingly. The input's plug can be realized as a back valve 711 for protection of backflow of fluid. The connector pipe 705 fluidly communicates with additional cameras' inputs 713. The connector pipe has an ability to be connected and disconnected with said cameras.

Through such realization of binding both cameras having a fluid communication by means of connector pipe 705 providing consummation the equal pressure throughout the entire system in both said cameras of said boots in case of pressurized, maintenance or faults the pressure in said cameras. It will automatically release binding if one foot happens to accidentally fall out by exerting the fluid pressure from one binding to the other binding that has just released the foot, causing a water recreation device to safely slide off the rider's foot and avoiding injury.

Figure 8:
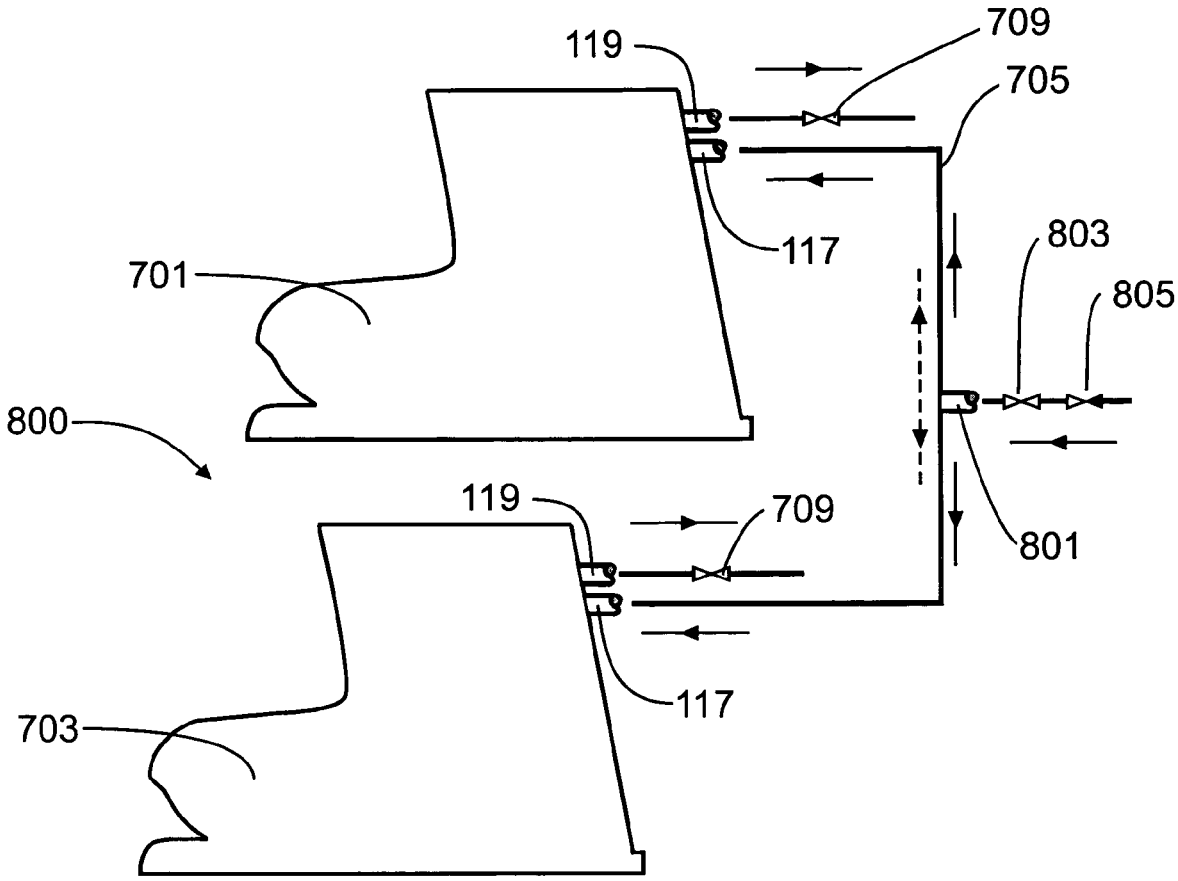
FIG. 8 diagrammatic shows an alternative embodiment of the present invention; in this embodiment the binding's connector pipe has a connector pipe's input for filling cameras and a plug or/and a back valve for its input and fluidly communicated directly with inputs of both cameras.

FIG. 8 diagrammatic shows an alternative embodiment 800 of the present invention. In accordance with this embodiment the binding comprised a pair of boots 701 and 703 with cameras (each camera is disposed inside of the binding body) wherein said cameras of both boots fluidly communicated with each other by means of connector pipe 705. Each camera has at least one input 117 for filling camera with fluid and at least one output 119 for emptying camera from said fluid. The outputs 119 are equipped with plugs 709. The connector pipe 705 has at least one connector pipe's input 801 for filling said cameras with said fluid and at least one plug 803 or/and at least one back valve 805 for said connector pipe's input, and fluidly communicated directly with inputs 117 of both said cameras. The connector pipe has an ability to be connected and disconnected with said cameras.

There are the following steps how the assembled binding is working:

a) providing an outflow said fluid from said cameras through their outputs 119 and said outputs' plugs 709;

b) providing an entering rider's foot into compartment (not shown);

c) providing a closing the outputs 119;

d) providing pressurization said fluid into said cameras through connector pipe 705 and their inputs 117 and maintenance of a necessary pressure of said fluid into cameras as far as of fixation the rider's feet into compartment 107; the consummation of a necessary pressure of said fluid into said cameras can be realize by means of tuning plugs 709 and 803;

e) providing opening plugs 709 of outputs 119 for providing an outflow said fluid from said cameras for providing an exiting rider's foot from said compartments.

Through such realization of binding is obtained not only equal pressure throughout the entire system and rising possibility of safety of a rider's feet in case of accident, but is gave a possibility to fill out both cameras throughout of connector pipe 705, which simplified usage of binding.

Figure 9:
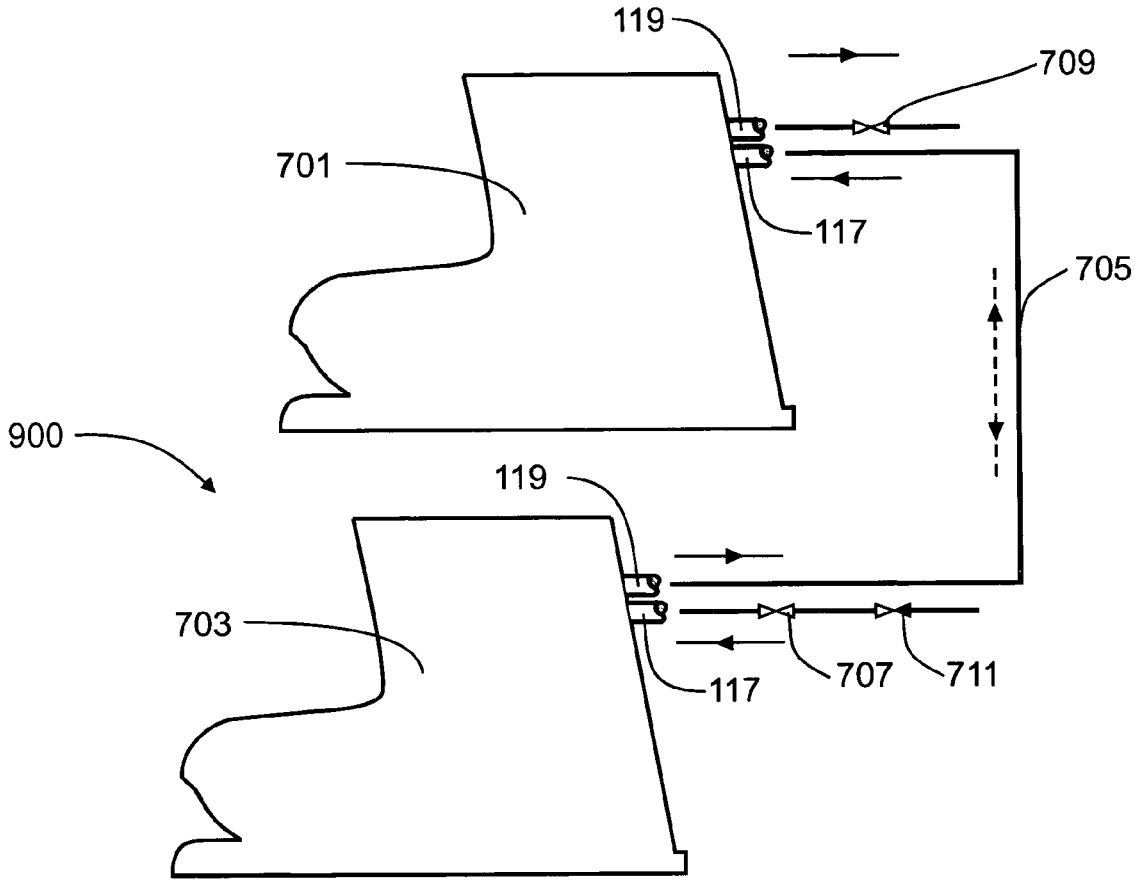
FIG. 9 diagrammatic shows an alternative embodiment of the present invention; in this embodiment the binding's connector pipe is fluidly communicated by one of its end with output of one of cameras and by another of its end with input of another of cameras and filling out both cameras is materialized throughout of input of one of the cameras and connector pipe.

FIG. 9 diagrammatic shows an alternative embodiment 900 of the present invention. In accordance with this embodiment the binding comprised a pair of boots 701 and 703 with cameras (each camera is disposed inside of the binding body) wherein said cameras of both boots fluidly communicated with each other by means of connector pipe 705. Each camera has at least one input 117 for filling camera with fluid and at least one output 119 for emptying camera from said fluid. Connector pipe 705 is fluidly communicated by one of its end with output 119 of one of said cameras and by another of its end with input 117 of another of said cameras. The free output 119 is equipped by a plug 709. The free input 117 is equipped by a plug 707 and/or a back valve 711 for protection of backflow of fluid.

Through such realization of binding is obtained, like in embodiment 800, not only equal pressure throughout the entire system and rising possibility of safety of a rider's feet in case of accident, but is gave a possibility to fill out both cameras throughout of input 117 of one of the cameras and connector pipe 705, which simplified usage of binding.

Figure 10:
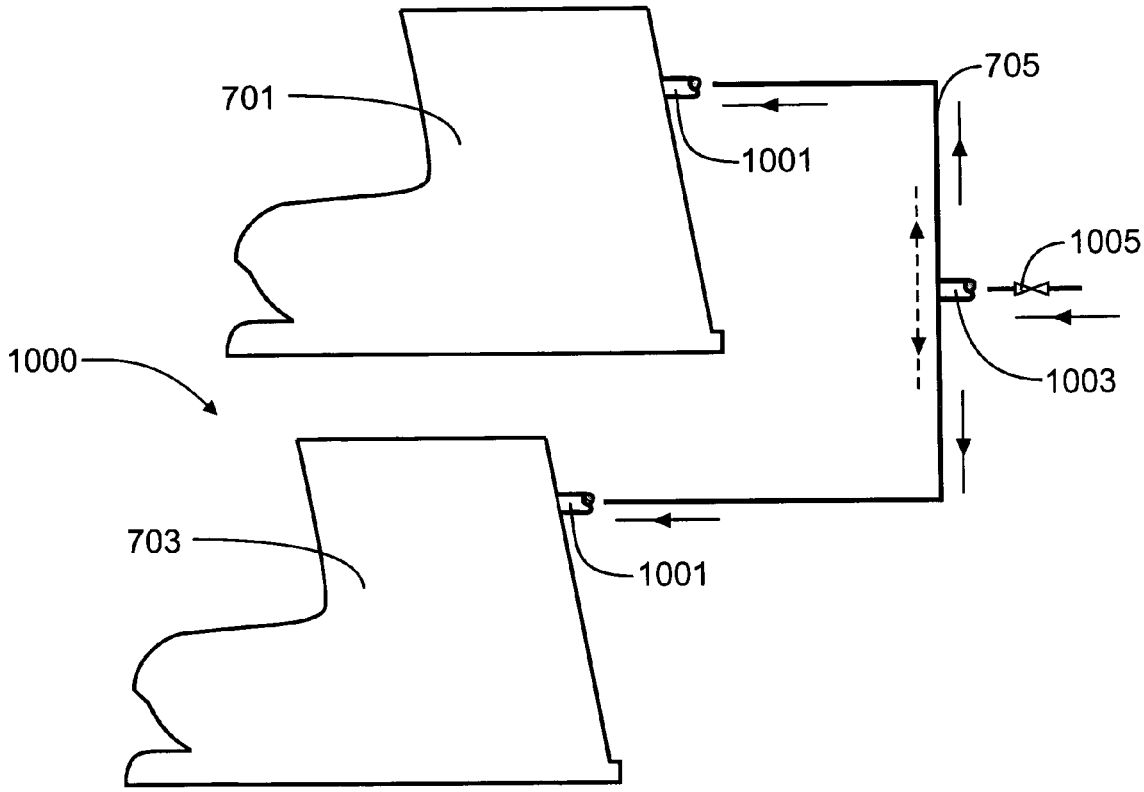
FIG. 10 diagrammatic shows an alternative embodiment of the present invention; in this embodiment each camera of binding has conjoint input and output, and filling out and emptying both cameras is materialized throughout the connector pipe.

FIG. 10 diagrammatic shows an alternative embodiment 1000 of the present invention. In accordance with this embodiment the binding comprised a pair of boots 701 and 703 with cameras (each camera is disposed inside of the binding body) wherein said cameras of both boots fluidly communicated with each other by means of connector pipe 705. Each of said cameras has conjoint input and output are realized as a unit 1001. The connector pipe 705 is fluidly communicated with units 1001 of both said cameras and can has a separated input and output both equipped by a plugs (not shown), and also connector pipe's input and output can be joint up and realized as a unit 1003, having one conjoint plug 1005. The delivery and removal the fluid to and from cameras can be realized throughout the conjoint plug 1005 and connector pipe's input-output unit 1003 which realize a function of input in delivery mode and function of output in removal mode.

Through such realization of binding is obtained notably simplified design and usage of binding and herewith to save its positive futures.

Figure 11:
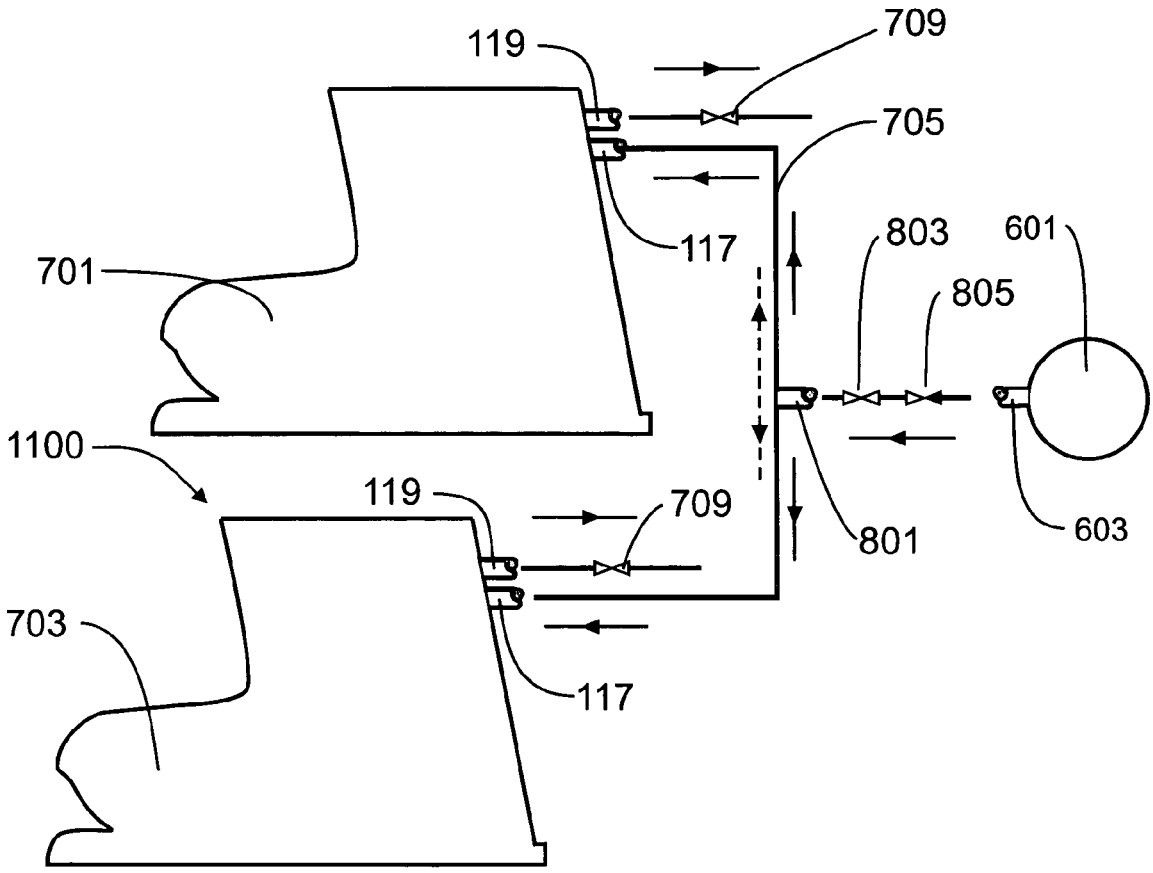
FIG. 11 diagrammatic shows an alternative embodiment of the present invention; in this embodiment the binding's cameras is additionally equipped with one conjoint means for pressurization the fluid into the both cameras through the connector pipe.

FIG. 11 diagrammatic shows an alternative embodiment 1100 of the present invention. In accordance with this embodiment the binding comprised a pair of boots 701 and 703 with cameras (each camera is disposed inside of the binding body) wherein said cameras of both boots fluidly communicated with each other by means of connector pipe 705. Each camera has at least one input 117 for filling camera with fluid and at least one output 119 for emptying camera from said fluid. The outputs 119 are equipped with plugs 709. The connector pipe 705 has at least one connector pipe's input 801 for filling said cameras with said fluid and at least one plug 803 or/and at least one back valve 805 for said connector pipe's input 801, and fluidly communicated directly with inputs 117 of both said cameras. The cameras of binding is additionally equipped with one conjoint means 601 for pressurization the fluid into the both cameras, fluidly communicated through its output 603 and through plug 803 or/and back valve 805 with input 801 of connector pipe 705. Upon actuating the means 601 for pressurization a fluid, the fluid is transferred into the cameras. The means 601 for pressurization can has many known embodiments (see description to FIG. 6).

Through such realization of binding at the same time with another advantages, immanent to another embodiments, this embodiment give to a rider a possibility offline to fill out the cameras and to be independent from a means for pressurization the fluid, located on a waterside or a tug.

Figure 12:
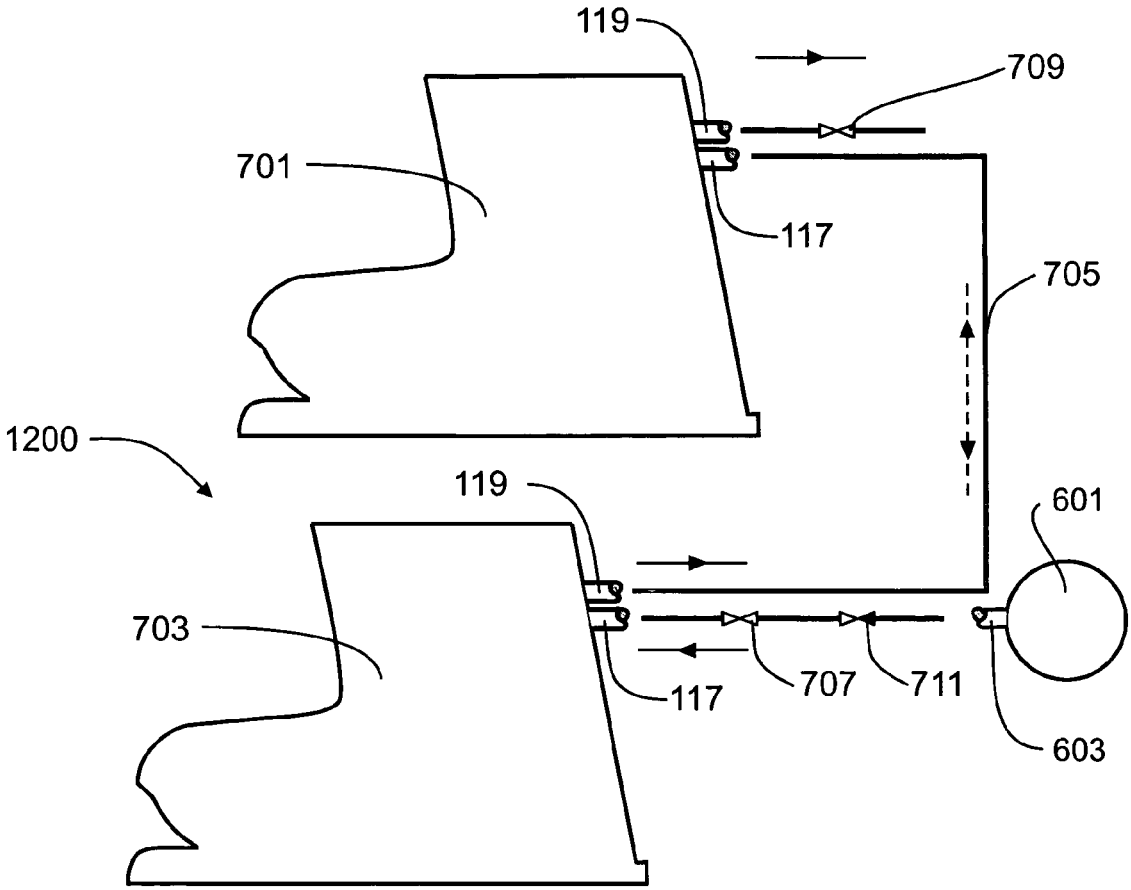
FIG. 12 diagrammatic shows an alternative embodiment of the present invention; in this embodiment the binding's cameras is additionally equipped with one conjoint means for pressurization the fluid into the both cameras and connector pipe is fluidly communicated by one of its end with output of one of said cameras and by another of its end with input of another of said cameras.

FIG. 12 diagrammatic shows an alternative embodiment 1200 of the present invention. In accordance with this embodiment the binding comprised a pair of boots 701 and 703 with cameras (each camera is disposed inside of the binding body) wherein said cameras of both boots fluidly communicated with each other by means of connector pipe 705. Each camera has at least one input 117 for filling camera with fluid and at least one output 119 for emptying camera from said fluid. Connector pipe 705 is fluidly communicated by one of its end with output 119 of one of said cameras and by another of its end with input 117 of another of said cameras. The free output 119 is equipped by a plug 709. The free input 117 is equipped by a plug 707 and/or by a back valve 711 for protection of backflow of fluid. The binding is additionally equipped with one conjoint means 601 for pressurization the fluid into the both cameras, fluidly communicated through its output 603 and through plug 707 or/and back valve 711 with free input 117 of one of the cameras. Upon actuating the means 601 for pressurization a fluid, the fluid is transferred into the cameras. The means 601 for pressurization can has many known embodiments (see description to FIG. 6).

Through such realization of binding is obtained, like in another embodiments, not only equal pressure throughout the entire system and rising possibility of safety of a rider's feet in case of accident, but is gave a possibility to fill out both cameras throughout of input 117 of one of the cameras and connector pipe 705, which simplified usage of binding. Also like in embodiment FIG. 11 this embodiment give to a rider a possibility offline fill out the cameras and be independent from a means for pressurization the fluid, located on a waterside or a tug.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. A binding for a water recreational device, comprising at least one boot for foot of a rider, said boot has a flexible interior compartment for placing a foot, wherein said binding equipped with sealed flexible inflatable/deflatable camera having an ability to fill/empty with/from fluid and said interior compartment having an ability to fix a rider's foot, when said fluid in said camera is under pressure, and to unfix a rider's foot, when the pressure of said fluid in said camera is released.

2. The binding of claim 1, wherein said camera is placed inside of said boot, covers at least a part of said compartment and has at least one input for filling said camera with said fluid and at least one output for emptying it from said fluid, and wherein said input and output are equipped with plugs.

3. The binding of claim 2, wherein said input's plug is shaped as a back valve for protection of backflow of said fluid.

4. The binding of claim 2, wherein said input and said output are realized as a unit and have one conjoint plug.

5. The binding of claim 2, wherein said camera shaped as a separate device having an ability to be placed inside and to be taken out of said boot.

6. The binding of claim 2, wherein at least a portion of said compartment is made with a double wall and wherein at least portion of walls of said compartment's double wall is made from a flexible material, and wherein said camera is placed inside of said double wall.

7. The binding of claim 6, wherein the walls of said camera are formed by the walls of said double wall.

8. The binding of claim 6, wherein exterior wall of said double wall of said interior compartment's body shaped as a portion of said boot's body.

9. The binding of claim 1, wherein said interior compartment body is made to be able to take out of and insert into said boot.

10. The binding of claim 1, wherein at least part of inside surface of said interior compartment is made with bulges or has an insert, shaped as a sock, made from elastic material, selected from the group consisting of materials with porous structures and/or bubbly structures, and herewith said insert has an ability to be placed on a rider's foot.

11. The binding of claim 1, wherein said binding is additionally equipped with means for pressurization said fluid into said camera and wherein upon actuating said means for pressurization said fluid, said fluid is transferred into said camera.

12. The binding of claim 1 comprising a pair of said boot with said camera wherein said cameras of both boots fluidly communicate with each other by means of at least one connector pipe.

13. The binding of claim 12, wherein said connector pipe has at least one connector pipe's input for filling said cameras with said fluid and at least one plug or/and at least one back valve for said connector pipe's input and fluidly communicated with inputs of both said cameras.

14. The binding of claim 12, wherein said connector pipe is fluidly communicated by one of its end with output of one of said cameras and by another of its end with input of another of said cameras.

15. The binding of claim 12, wherein each of said cameras has conjoint input and output are realized as a unit, said connector pipe has an input and an output both equipped by a plugs, herewith said connector pipe's input and output can be joint up and realized as a connector pipe's input-output unit, having one conjoint plug, and said connector pipe fluidly communicated with said both camera's input-output units, providing the delivery and removal said fluid.

16. The binding of claim 12, wherein said cameras additionally equipped with one conjoint means for pressurization said fluid into both said cameras fluidly communicated with said connector pipe or directly with one of said cameras.

17. A method for facilitating the entry/exit of a foot for a rider into/from the binding of a water recreational device, having at least one boot for foot of a rider, said boot having an interior compartment for placing a foot, comprising:

a) providing onto said binding its equipping by sealed flexible inflatable/deflatable camera having an ability to fill/empty with/from fluid and providing said binding by interior compartment having an ability to fix a rider's foot, when said fluid in said camera is under pressure, and to unfix a rider's foot, when the pressure of said fluid in said camera is released;

b) providing an outflow said fluid from said camera through its output for providing an entering rider's foot into said compartment;

c) providing a closing of said camera's output;

d) providing pressurization said fluid into said camera through its input as far as of fixation the rider's feet into said compartments;

e) providing maintenance of a necessary pressure of said fluid into said camera;

h) providing an opening said output for providing an outflow said fluid from said camera through said output for providing an exiting rider's foot from said compartment.

18. The method of claim 17 wherein said camera having an output's and input's plugs and an input's plug shaped as a back valve comprising:

providing pressurization said fluid into said cameras through said back valve in phase of fixation rider's foot in said compartment and providing maintenance of a necessary pressure of said fluid into said camera.

19. The method of claim 17 wherein in said binding said input and said output are realized as a unit and have one conjoint plug comprising:

a) providing an opening said conjoint plug for emptying said fluid from said camera in phase of exiting/entering rider's foot from/into said compartment;

b) providing pressurization said fluid into said cameras through open said conjoint plug in phase of fixation rider's foot in said compartment;

c) providing a closing said conjoint plug for providing maintenance of a necessary pressure of said fluid into said camera.

20. The method of claim 17 wherein said interior compartment body is made to be able to get out from and insert into said boot comprising:

a) providing a getting out said compartments from said boots;

b) providing an entering rider's foot into said compartment;

c) providing an entering said compartment with rider's foot into said boot.

21. The method of claim 17 wherein said interior compartment having an insert, shaped as a sock, made from elastic material, selected from the group consisting of materials with porous structure and/or bubbly structure, and herewith said insert has an ability to be placed on a rider's foot, comprising:

a) providing a getting out said insert from said compartment;

b) providing an entering rider's foot into said insert;

c) providing an entering rider's foot vested in said insert into said compartment;

d) providing pressurization said fluid into said camera of said binding as far as of fixation the rider's foot vested in said insert into said compartment and maintenance of a necessary pressure of said fluid into said camera, and e) providing an outflow said fluid from said camera for providing an exiting rider's foot vested in said insert from said compartment.

22. The method of claim 17 wherein said binding is additionally equipped with means for pressurization said fluid into said camera comprising:

a) providing actuating means for pressurization said fluid;

b) providing pressurization said fluid into said camera by means for pressurization said fluid through camera's input and maintenance of a necessary pressure of said fluid into said camera as far as of fixation the rider's feet into compartment.

23. The method of claim 17 wherein said binding including a pair of said boot with said camera and wherein said cameras of both boots fluidly communicated with each other by means of at least one connector pipe, comprising providing consummation the same pressure in both said cameras of said boots in case of pressurized, maintenance or faults the pressure in said cameras comprising:

a) providing an outflow said fluid from said cameras through their outputs and said outputs' plugs or by means of disconnection connector pipe from said cameras;

b) providing an entering rider's feet into compartments;

c) providing closing outputs;

d) providing pressurization said fluid into said cameras' inputs and maintenance of a necessary pressure of said fluid into cameras as far as of fixation the rider's feet into said compartments;

e) providing an opening at least one of plugs of said outputs or a disconnection connector pipe from said cameras for providing an outflow said fluid from said cameras for providing a release rider's feet from the binding and exiting rider's feet from said compartments.

24. The method of claim 23 wherein said connector pipe has at least one connector pipe's input for filling said cameras with said fluid and at least one plug or/and at least one back valve for said connector pipe's input, and fluidly communicated with inputs of both said cameras comprising:

a) providing an outflow said fluid from said cameras through their outputs and said outputs' plugs or by means of disconnection connector pipe from said cameras;

b) providing an entering rider's feet into compartments;

c) providing closing outputs;

d) providing pressurization said fluid into said cameras through connector pipe and cameras' inputs and maintenance of a necessary pressure of said fluid into cameras as far as of fixation the rider's feet into said compartments;

e) providing opening plugs of said outputs or a disconnection connector pipe from said cameras for providing an outflow said fluid from said cameras for providing an exiting rider's foot from said compartments.

25. The method of claim 23, wherein said connector pipe is fluidly communicated by one of its end with output of one of said cameras and by another of its end with input of another of said cameras comprising:

a) providing an emptying both of said cameras and b) providing a pressurization both said cameras through one of inputs of said cameras and said connector pipe.

26. The method of claim 23, wherein each of said cameras has conjoint input and output are realized as a unit, said connector pipe has an input and an output both equipped by a plugs, herewith said connector pipe's input and output can be jointed up and realized as a connector pipe's input-output unit, having one conjoint plug, and said connector pipe fluidly communicated with said both camera's input-output units, providing the delivery and removal said fluid comprising:

a) providing an emptying said fluid from said cameras, predominantly, throughout said connector pipe and said conjoint plug in phase of exiting/entering rider's foot/feet from/into said compartment/compartments;

b) providing pressurization said fluid into said cameras throughout said connector pipe through open said conjoint plug in phase of fixation rider's foot/feet in said compartment/compartments;

c) providing a closing said conjoint plug for providing maintenance of a necessary pressure of said fluid into said cameras.

27. The method of claim 23, wherein said cameras additionally equipped with one conjoint means for pressurization said fluid into both said cameras, fluidly communicated with said connector pipe and through it with said inputs of said cameras, comprising:

a) providing an emptying said fluid from said cameras in mode of exiting/entering rider's foot/feet from/into said compartment/compartments;

b) providing a closing said cameras output's plugs;

c) providing pressurization said fluid into said cameras through said means for pressurization said fluid throughout said connector pipe through open said conjoint plug in phase of fixation rider's foot/feet in said compartment/compartments;

d) providing a closing an input in said connector pipe for providing maintenance of a necessary pressure of said fluid into said cameras.

28. The method of claim 23, wherein said cameras additionally equipped with one conjoint means for pressurization said fluid into both said cameras, fluidly communicated directly with an input of one of said cameras, and wherein said connector pipe is fluidly communicated by one of its end with output of said one camera and by another of its end with input of said another of said cameras, herewith a free output of said another camera is equipped by a plug comprising:

a) providing an emptying said fluid from said cameras in mode of exiting/entering rider's foot/feet from/into said compartment/compartments;

b) providing a closing said free output's plug from said another camera;

c) providing pressurization said fluid into said cameras through said means for pressurization said fluid throughout said connector pipe, throughout open plug of said input of said one of said cameras in phase of fixation rider's foot/feet in said compartment/compartments;

d) providing a closing an input of said one camera for providing maintenance of a necessary pressure of said fluid into said cameras.

* * * * *